US005718644A

United States Patent [19]

Donofrio

[11] Patent Number: 5,718,644

[45] **Date of Patent: *Feb. 17, 1998**

[54] INSERT FOR GOLF CLUB PUTTER HEAD

[76] Inventor: Matt Donofrio, Greenbrier Ct., Apt G—Basement, Clifton, N.J. 07012

[ * ] Notice: The term of this patent shall not extend beyond the expiration date of Pat. No. 5,501,461.

[21] Appl. No.: 589,836

[22] Filed: Jan. 22, 1996

Related U.S. Application Data

[63] Continuation-in-part of Ser. No. 335,041, Nov. 7, 1994, Pat. No. 5,501,461.

[51] Int. Cl.[6] ..... A63B 53/04

[52] U.S. Cl. ..... 473/340; 473/342; 473/330

[58] Field of Search ..... 473/324, 325, 473/327, 328, 330, 340, 342, 345, 350

[56] References Cited

U.S. PATENT DOCUMENTS

| | | | |
|---|---|---|---|
| 2,530,446 | 11/1950 | Beardsley . | |
| 3,310,309 | 3/1967 | Moss . | |
| 3,368,812 | 2/1968 | Baldwin, Sr. . | |
| 3,909,005 | 9/1975 | Piszel | 473/330 |
| 4,618,149 | 10/1986 | Maxel . | |
| 4,725,062 | 2/1988 | Kinney, III . | |
| 4,872,684 | 10/1989 | Dippel | 473/330 |
| 4,884,808 | 12/1989 | Retzer . | |
| 5,028,049 | 7/1991 | McKeighen | 473/345 |
| 5,141,231 | 8/1992 | Cox | 473/330 |
| 5,310,185 | 5/1994 | Viollaz et al. . | |
| 5,345,060 | 9/1994 | Wooten | 473/330 |
| 5,377,986 | 1/1995 | Viollaz et al. . | |
| 5,403,007 | 4/1995 | Chen . | |
| 5,437,447 | 8/1995 | Rigutto | 473/330 |
| 5,458,332 | 10/1995 | Fisher | 473/342 |
| 5,467,538 | 11/1995 | Chou et al. | 33/508 |
| 5,501,461 | 3/1996 | Donofrio | 473/330 |

*Primary Examiner*—Steven B. Wong
*Attorney, Agent, or Firm*—Graham & James LLP

[57] ABSTRACT

An insert member for a golf putter, with one face of the insert being adapted to fittingly engage the putting face of a head of the golf putter by means of adhesive, mechanical fasteners, or other fastening means, including by frictional fit, when the insert is fitted within a cutout on the face of the putter. The other face of the insert, which is thereby situated in a putting position for engagement with a golf ball, comprises a regular, elongated curved surface such as an arc section of a cylinder. The elongated curved surface is longitudinally positioned in alignment with a longitudinal axis of the putter head and is preferably of a dimension and position for putting engagement with a golf ball below the equator of the ball. If desired, for whatever purpose, such as for generating top-spin or minimized spin, the vertical position of the curved surface, may be adjusted on the face of the putter head, particularly with an adhesive fitting on a flat putter head face surface. The insert is comprised of titanium, titanium alloy, anodized aluminum, or high strength plastic, which enhances trueness of contact with a golf ball being putted.

9 Claims, 1 Drawing Sheet

INSERT FOR GOLF CLUB PUTTER HEAD

This is a continuation-in-part of U.S. application Ser. No. 08/335,041, filed Nov. 7, 1994, now U.S. Pat. No. 5,501,461.

FIELD OF THE INVENTION

This invention pertains to the construction and configuration of golf clubs and more specifically to golf club putters.

BACKGROUND OF THE INVENTION

Golf clubs are designed for use in hitting golf balls in a variety of ways, all of which require a sufficient applicable force and accuracy in order to most expeditiously propel the golf ball toward a designated ground hole goal or cup. Various golf clubs are used to provide various propelling functions. The initially used driver is designed for use in providing maximum lofted propulsion over a large distance (usually measured in hundreds of yards). Putters, used in the final approach to the hole, are at the opposite end of the golf spectrum wherein distance is subservient to extreme accuracy in causing the ball to be propelled across the ground and into the hole or cup.

The art of putting has eluded perfection by even the most ardent and talented golfers. Yet, the number of putts required to sink the ball often represents as much as half of the golfer's total score. Since a golfer is limited to a single putter over an entire round of play, the nature of the putter is important in permitting a golfer to play the best possible game.

Putting requires a high degree of skill and accuracy in which a properly designed club can enhance a player's natural and learned abilities. Numerous factors, which often involve tradeoffs, are taken into account in the design of a club head for a putter and which relate to the putter's action during the swing and upon impact with the ball. These factors include moment of inertia, lateral dispersion, weight, club head material, shape of the striking face, shaft alignment, sighting means and face balance. Such factors relate to the rotational stability of the club during the swing, the maximum energy transfer from the club to ball, the balance, the resistance to twisting upon impact with the ball, even if hit off center, and the ability of the club to impart the maximal rotational energy on the golf ball to produce a natural rolling motion from point of impact.

The most common design for a golf putter includes a flat putting face, usually perceived as being necessary for best control. In some instances, putter heads have been designed with convex striking surfaces in the form of longitudinal section of a cylinder or other regular elongated radial surface. These convex striking surfaces take advantage of the ability of a convex surface striking another convex surface (the ball) at a point below the equator of the ball (the putter diameter being less than that of the ball) to create a forward roll from the point of impact. The full advantage of the convex striking surface has however not been taken with respect to the prior art, since specific compositions provide advantages in inertial trueness in striking and resultant roll.

In the parent of this application a titanium putter head, with a cylindrical section having a curved striking face, was described. Putters with the titanium head provided marked improvements in putting capability. Similarly, but to a lesser extent anodized aluminum and high strength polymers provided the same effect. However, particularly with respect to the use of titanium, a full putter head (or even a full cylindrical section) made of such material can, for the occasional or amateur golfer, be prohibitively expensive. In addition, a full cylindrical design is radical in comparison to the industry standard and therefore is sometimes derogatorily viewed as a "gimicky" club. There are also numerous putters which are well designed and accordingly an entirely new head is not desirable, but nevertheless such existing head can be markedly improved in performance with the addition of an improved ball striking surface.

It is therefore an object of the present invention to provide an economical golf putter head with an improved ball striking surface;

It is a further object of the present invention to provide a means for retrofitting existing putters with the improved ball striking surface.

It is yet another object of the present invention to provide a conventionally appearing putter but with improved ball striking capability.

These and other objects, features and advantages of the present invention will become more evident from the following discussion and drawings in which:

SHORT DESCRIPTION OF THE DRAWINGS

FIG. 1 shows a putter head having a flat putting face (or a curved face as shown in phantom) being fitted with a curved face insert and the relation of the insert, relative to an adjacent golf ball; and FIG. 2 shows a putter head with the curved face insert of FIG. 1 being positioned within a correspondingly sized cutout in the face of the putter head.

SUMMARY OF THE INVENTION

Generally the present invention comprises an insert member for a golf putter, with one face of the insert being adapted to fittingly engage the putting face of a head of the golf putter by means of adhesive, mechanical fasteners, or other fastening means, including by frictional fit, when the insert is fitted within a cutout on the face of the putter. The other face of the insert, which is thereby situated in a putting position for engagement with a golf ball, comprises a regular, elongated curved surface such as an arc section of a cylinder. The elongated curved surface is longitudinally positioned in alignment with a longitudinal axis of the putter head and is preferably of a dimension and position for putting engagement with a golf ball below the equator of the ball. If desired, for whatever purpose, such as for generating top-spin or minimized spin, the vertical position of the curved surface, may be adjusted on the face of the putter head, particularly with an adhesive fitting on a flat putter head face surface.

The insert is comprised of titanium, titanium alloy, anodized aluminum, or high strength plastic, which enhances trueness of contact with a golf ball being putted.

DETAILED DESCRIPTION OF THE INVENTION

In accordance with the present invention, the insert is positioned on the putter head such that the curved section of the insert fully extends across the "sweet portion" of the putter head (defined as the area of the putter head designed to contact the ball with a balanced swing). The insert member, in a highly preferred embodiment, is comprised of titanium or titanium alloy and the rest of the putter head carries the weight by being comprised of a heavier material such as stainless steel. Alternatively, the insert may be comprised of anodized aluminum or a high strength engineering plastic, with improved putting capability but of a lesser extent. It is noted that golf club driver heads have been made of titanium or with titanium head inserts. However, titanium enhancement of drives with ball compression, with the high impact forces exerted by a driver, is no indication of the ability of the material to enhance minimal contact force putting.

The insert is attached to the usually flat putter face, preferably by means of high strength epoxy. Alternatively, the insert is attached by bolts, screws, integral latches and may even be welded or brazed on, depending on the materials involved and with the caveat that club head balance not be affected thereby. With putter heads initially adapted for use with interchangeable inserts, cutouts in the face of the putter head, sized to accommodate a portion of the insert, provide another preferred manner of attachment.

The adhered face, as described (except for some putter heads initially adapted for inter-fitted engagement with the insert), is usually flat. However, if it is desired to provide a titanium face plate to an already curved surface, the adhering surface of the face plate is conformed thereto for positive adherence. The peripheral configuration of the insert is immaterial except to the extent that it may affect head balance. A peripheral rectangular configuration for the insert is preferred since it is more readily aligned with the longitudinal axis of the head to maintain the head balance.

The arc of a cylinder section preferably ranges from about 90° to 180°. A too large arc is awkward for alignment, use and disposition on the putter head and a too small arc provides insufficient material for effective contact.

Though the above description is with respect to an insert added to an existing putter head, the present invention is similarly applicable to integrally fabricated putter heads with the insert portion.

DETAILED DESCRIPTION OF TEE DRAWINGS AND THE PREFERRED EMBODIMENTS

Figure 1:
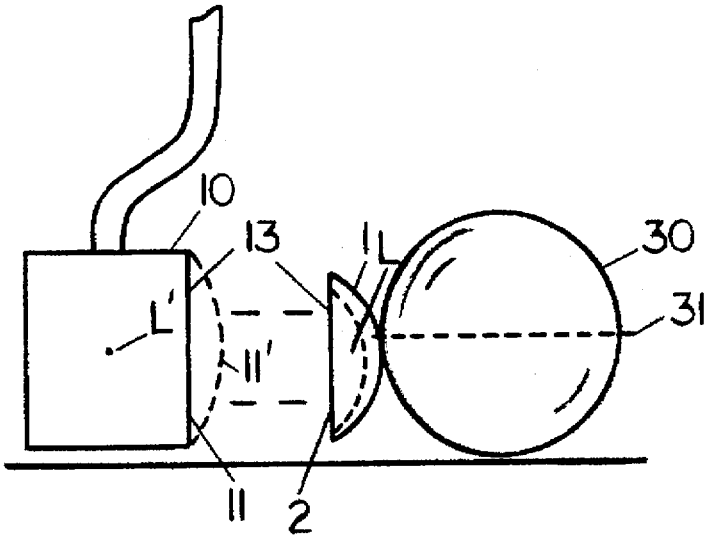

With reference to the drawings, in the Figures, putter club heads 10 and 10' respectively are provided with curved inserts 1 and 1' respectively on their respective putting faces (11 and 11"). A primary means of attachment is by epoxy 13, which is placed on face 11 of the putter head 10 and on corresponding surface 2 of the insert 1. Longitudinal axis L (preferably along its center of gravity) of the insert is aligned with the longitudinal axis L' of putter head 10 prior to adhesion. Other means of adhesion are possible such as with bolts and the like but these are more difficult to employ. As shown in phantom in FIG. 1, putting face 11' may be initially curved whereby insert 1 is correspondingly curved, as also shown in dotted line.

Figure 2:
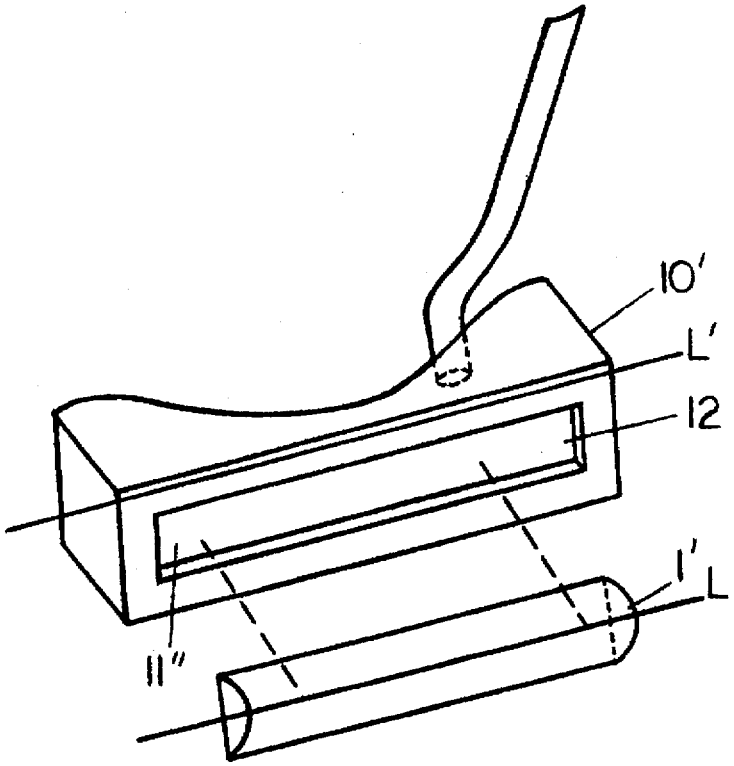

In a secondary embodiment, as shown in FIG. 2, the putter head 10' is initially formed with cutout 12, sized and shaped to engage the base surface of insert 1'. In this embodiment the insert is fitted into correct orientation by placement within cutout 12 and is retained therewithin either by a frictional fit, adhesive, or other mechanical fasteners. With both embodiments, the curve of the inserts 1 and 1' is adapted to engage golf ball 30 below its equator 31 whereby the effects of the titanium (or similar material) contact area of the insert are noticeable in enhancing trueness of putting.

It is understood that the above description and drawings are exemplary of preferred embodiments and that changes may be made in construction and relative configuration of components of the putter and insert without departing from the scope of the present invention as defined in the following claims.

What is claimed is:

1. A golf putter head with an insert member, the insert member being comprised of titanium or titanium alloy and having two faces, wherein a first face of the insert member is adapted to fittingly engage the putting face of a head of the golf putter, whereby the other face of the insert member is thereby situated in a putting position for engagement with a golf ball, and with said other face of the insert member comprising a regular elongated curved surface adapted to be longitudinally positioned in alignment with a longitudinal axis of the putter head, with said curved surface adapted to be of a dimension and position on the putter head for putting engagement with a golf ball below the equator of the ball.

2. The golf putter head of claim 1, wherein the curved surface comprises an arc section of a cylinder.

3. The insert member of claim 1, wherein the insert consists essentially of titanium.

4. The golf putter head of claim 3, wherein the insert is adhered to the putting face of the golf putter by any one of adhesive means and mechanical fastener means.

5. The golf putter head of claim 3, wherein the putting face of the golf putter comprises a cutout section and wherein the insert member comprises a base section as the first face, which base section is adapted to be closely fitted into the cutout section.

6. The golf putter head of claim 5 wherein the base section is adhered to the putting face within the cutout section.

7. The golf putter head of claim 3, wherein the putting face of the golf putter is curved and the first face is correspondingly fittingly curved.

8. A golf putter, having a putting member integrated with a putting head thereof, said putting member being comprised of titanium or titanium alloy and having an exposed putting face situated in a putting position for engagement with a golf ball, and comprising a regular elongated curved surface longitudinally positioned in alignment with a longitudinal axis of the putter head, with said curved surface adapted to be of a dimension and position on the putter head for putting engagement with a golf ball below the equator of the ball.

9. A golf putter head with an insert member, the insert member being comprised of titanium or titanium alloy and having two faces, wherein a first face of the insert member is adapted to fittingly engage the putting face of a head of the golf putter, whereby the other face of the insert member is thereby situated in a putting position for engagement with a golf ball, and with said other face of the insert member comprising a regular elongated curved surface adapted to be longitudinally positioned in alignment with a longitudinal axis of the putter head wherein the curved surface defines an arc section adapted to be of a dimension and position on the putter head for putting engagement with a golf ball below the equator of the ball.

* * * * *